US005357840A

United States Patent [19]

Wanits

[11] Patent Number: 5,357,840

[45] Date of Patent: Oct. 25, 1994

[54] BORE OBSTRUCTION DETECTION INDICATOR

[75] Inventor: Charles F. Wanits, Ballston Lake, N.Y.

[73] Assignee: The United States of America as represented by the Secretary of the Army, Washington, D.C.

[21] Appl. No.: 147,246

[22] Filed: Nov. 4, 1993

[51] Int. Cl.[5] ..... F41A 21/00; F41A 35/00

[52] U.S. Cl. ..... 89/1.1; 42/1.01; 89/14.05

[58] Field of Search ..... 89/1.1, 14.05; 42/1.01

[56] References Cited

U.S. PATENT DOCUMENTS

| | | | |
|---|---|---|---|
| 2,469,400 | 5/1949 | Newell | 89/1.1 |
| 3,902,368 | 9/1975 | Hasenbein et al. | 89/14.05 |
| 5,078,045 | 1/1992 | Audino et al. | 89/1.1 |

*Primary Examiner*—David Brown

*Attorney, Agent, or Firm*—Anthony T. Lane; Edward Goldberg; Michael C. Sachs

[57] ABSTRACT

A resettable bore obstruction detector indicator is positioned on the muzzle end of a gun bore to indicate whether the gun bore is free from obstruction after a round has been loaded.

7 Claims, 4 Drawing Sheets

BORE OBSTRUCTION DETECTION INDICATOR

GOVERNMENT INTEREST

The invention disclosed herein may be manufactured, used and licensed by or for the United States Government.

BACKGROUND OF THE INVENTION

The problem of obstructed cannon tube bore has occurred ever since cannon tubes were extended forward of the front end of a tank chassis. Presently a round can be fired from a tank without the crew's knowledge that the muzzle end of the cannon is plugged with an obstruction such as mud or sand. Firing the cannon in this condition may result in damaging the muzzle end of the tube so severely that the tube would probably have to be scrapped. Visually checking a bore prior to loading a round in the gun chamber is not a problem. However, once the round has been chambered and the vehicle has been moved to another location, as usually occurs in tactical situations, there is no procedure or device to tell the gunner that the gun bore is unobstructed. Normally when tank crews conduct tactical maneuvers, they check the bore, load the round, close the breech block, then drive to various locations frequently over uneven terrain and fire the round either on the move or sitting stationary. In combat a crew does not have the time to unchamber the round and visually check for obstructions before firing. If along the route the muzzle end of the tube dipped accidentally into a sand berm or mud bank without the tank crew's knowledge, serious damage can occur to the cannon if the crew fires a round under this condition.

Present day cost for a gun tube is approximately $28,000. The present invention is instrumental in reducing the cost for repair or replacement of a cannon damaged as a result of firing a cannon that has been accidentally plugged with obstructive materials.

SUMMARY OF THE INVENTION

The present invention relates to a resetable bore obstruction detection indicator which is operatively positioned on the muzzle end of a tank gun to warn the gun crew if the muzzle end of the gun hit an obstruction after a round has been chambered in the breech block.

An object of the present invention is to provide immediate detection of a possible bore obstruction.

Another object of the present invention is to provide a low profile, light weight, add on assembly to existing equipment without any modification to the original gun system.

Another object of the present invention is to increase weapon confidence level.

Another object of the present invention is to provide reduction in cost of repair of obstructed gun tube damage.

Another object of the present invention is to reduce downtime for repair or replacement of obstructed cannon tubes.

Another object of the present invention is to provide a bore obstruction indicator which if damaged would not affect the use of the gun system.

A further object of the present invention is to provide a low cost, durable bore obstruction indicator.

For a better understanding of the present invention, together with other and further objects thereof, reference is made to the following description taken in connection with the accompanying drawings.

BRIEF DESCRIPTION OF THE DRAWINGS

Throughout the following description like reference numerals are used to denote like parts of the drawings.

DETAILED DESCRIPTION OF THE PREFERRED EMBODIMENTS

Figure 1:
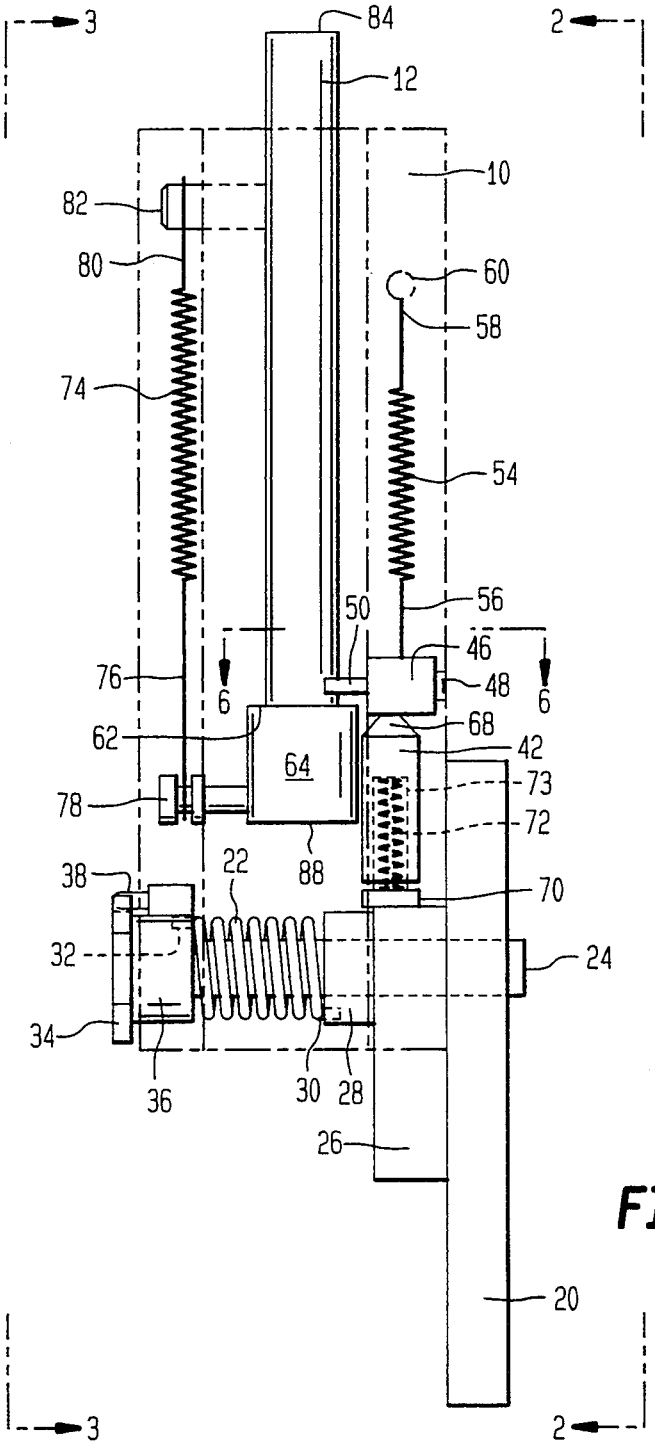
FIG. 1 is a cut-away plan view of the triggering elements of the cannon obstruction indicator in its untriggered position.
Figure 6:
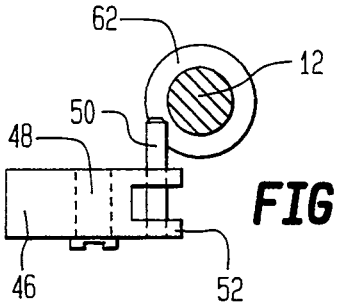
FIG. 6 is a partial cross-sectional view of the obstruction indicator taken along line 6—6 of FIG. 1.
Figure 5:
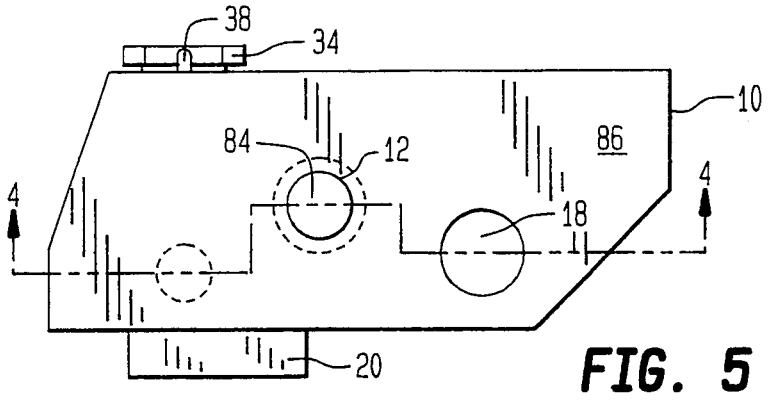
FIG. 5 is a top plan view of FIG. 2 taken along line 5—5.

Referring now to FIGS. 1, 2, 3 and 6 a housing 10 supports a bore obstruction detector post indicator 12 slidably therein by axially aligned housing bores 14 and 16. The housing 10 is connected to the front end of a cannon muzzle brake bracket, not shown, by means of screws passing through the muzzle brake into housing attachment bore 18 and 18'. In the untriggered operating position, housing 10 operatively supports trigger member 20 in a vertical position. Trigger member 20 has a torque force applied to it by means of a trigger tension spring 22. A variable tension adjuster trigger shaft 24, which is rotatably held by housing 10, fixedly holds a cam member 26 intermediate trigger 20 and a spring collar 28. Trigger helical tension spring 22 has a first end 30 fixed to spring collar 28 and a second end 32 fixedly attached to a rotatable detented hex-shaped variable adjustor screw 34 having a boss 36 therein. Detent pin 38 slidably positioned in housing 10 and hex screw groove 40 locks screw 34 in position desired for applying torque to trigger 20. A spring loaded cylindrical plunger member 42 is slidably positioned in housing plunger bore 44 between trigger cam 26 and roll pin lever 46. Roll pin lever 46 pivots about a pivot pin 48 which is fixedly held in housing 10. Pin lever 46 holds a roll pin 50 on a first bifurcated lever end 52. A pin spring 54 has a first end 56 fixedly attached to the roll pin 50 at the bifurcated lever end 52 and a second end 58 operatively attached to housing pin spring anchor 60. Roll pin 50 rests against post indicator shoulder 62 of the enlarged post indicator base 64. The second lever end 66 rests on top of plunger top contact end 68. A plunger bottom contact member 70 is held against can 26 by plunger compression spring 72 located in plunger spring bore 73 when the obstruction detector indicator is in the normal untriggered position. A post indicator spring 74 under tension has a bottom end 76 operatively attached to post pin anchor 78 and a top end 80 connected to housing spring anchor 82.

Figure 2:
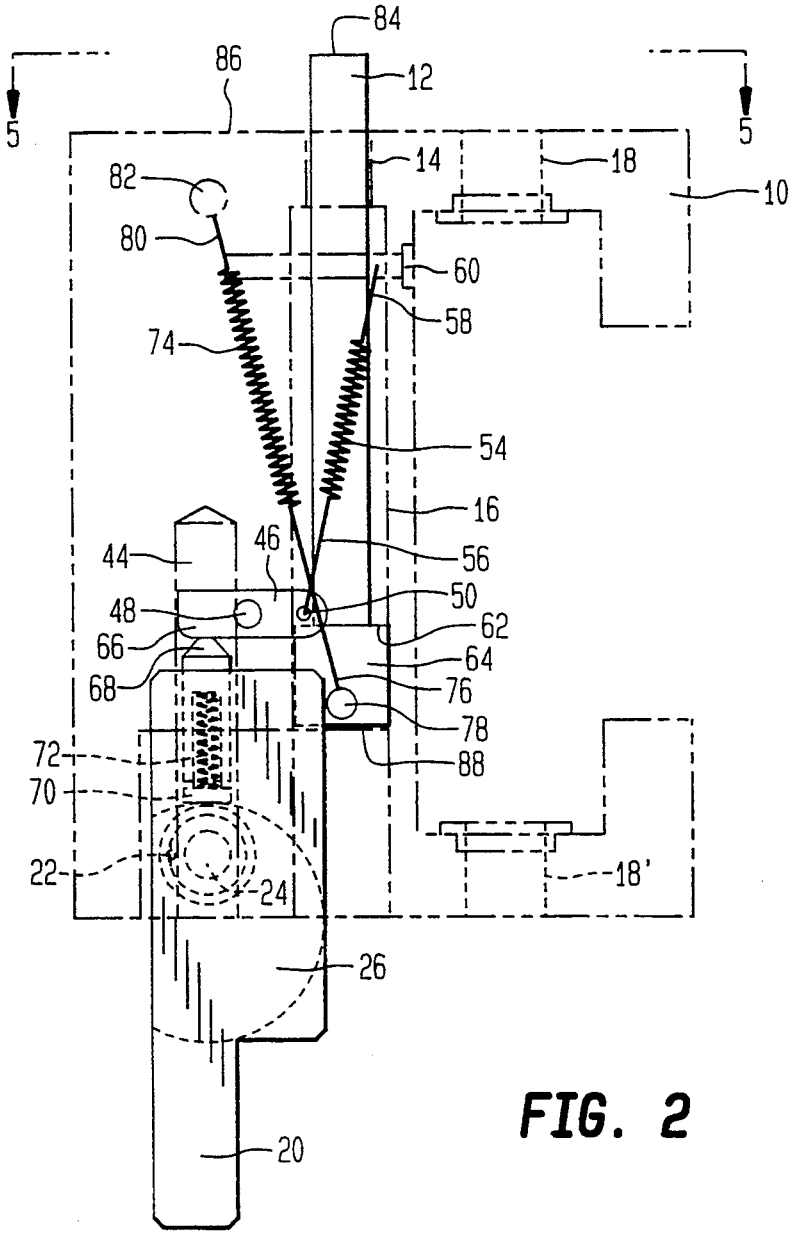
FIG. 2 is a cut-away plan view of FIG. 1 taken along line 2—2.
Figure 3:
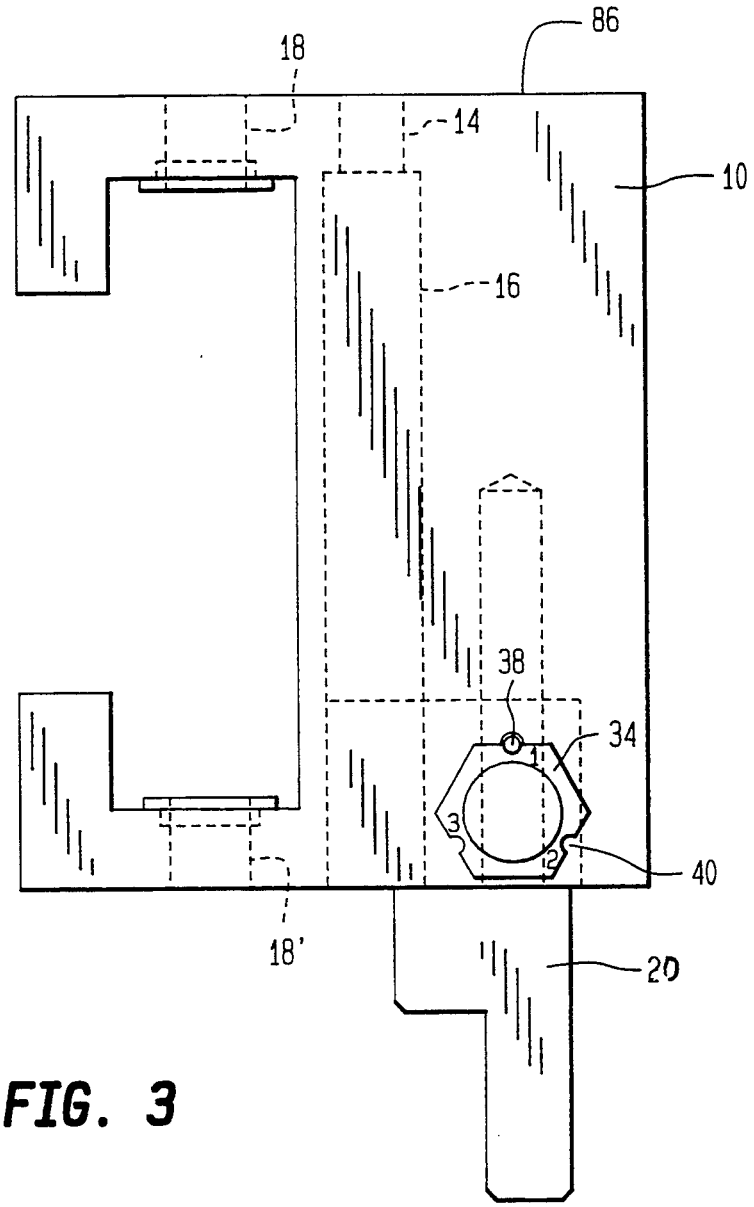
FIG. 3 is a plan view of FIG. 1 taken along line 3—3.
Figure 4:
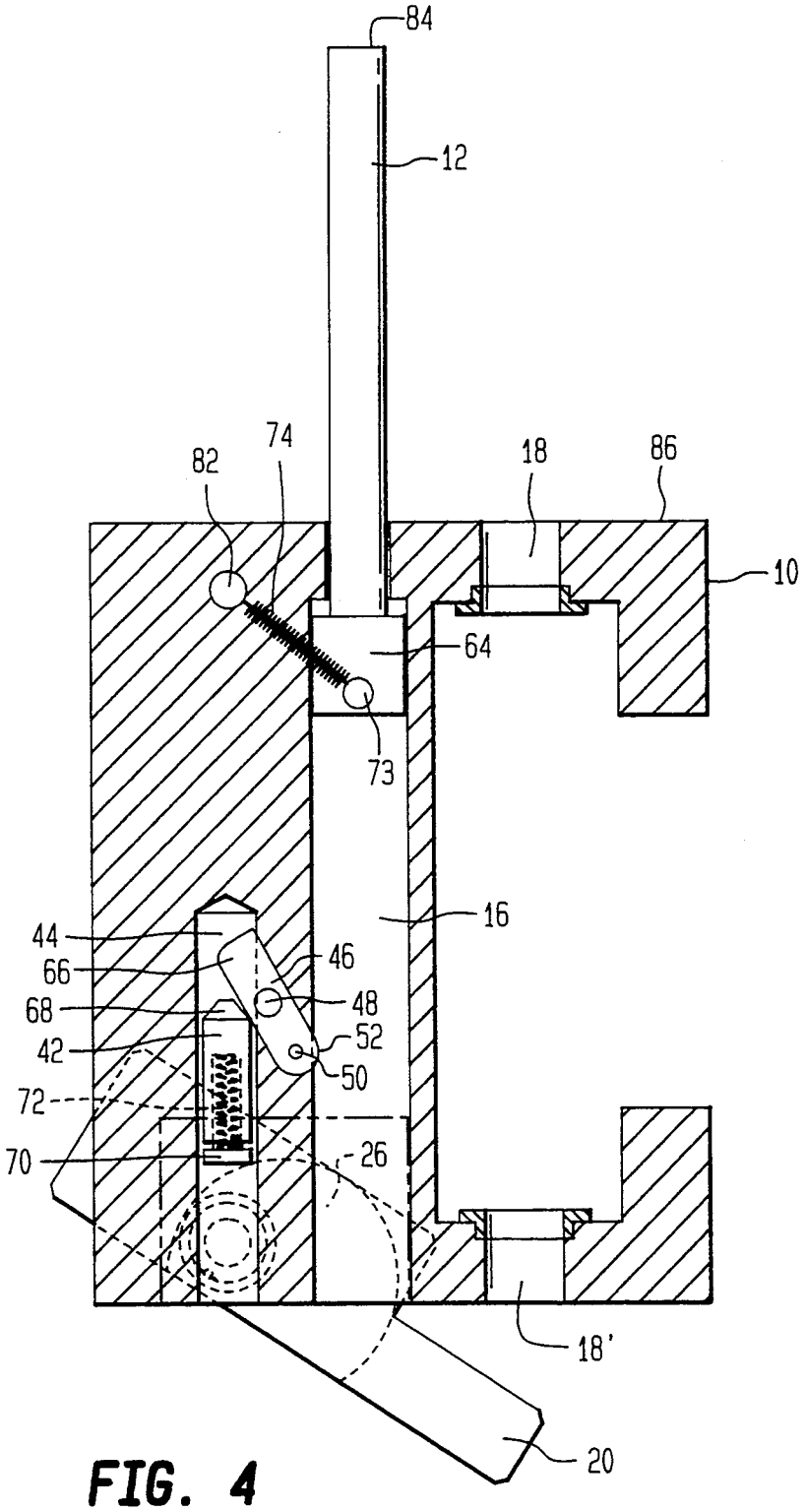
FIG. 4 is a partial cross-sectional view taken along line 4—4 of FIG. 5.

In operation, once the body 10 is assembled to the gun tube, not shown, by screws passing through housing attachment bores 18, 18', the trigger 20 is checked to see that it is vertical with the front face of housing 10 as shown in FIGS. 1–3. Warning post indicator 12 is pushed downward until the top surface 84 of post spring 12 is flush with the top housing surface 86 and an audible click is heard, then post 12 is released. The warning indicator post 12 will be drawn back upward by post spring 74, approximately ¼ of an inch above the top surface 86 of housing 10. This is the set and locked position until trigger 20 is activated as shown in FIG. 4. While the warning post indicator 12 is depressed, post spring 74 is placed in tension tending to pull warning post 12 in an upward direction. However, the enlarged post indicator rear end 64 will contact roll pin 50 which is secured to roll pin lever 46 and prevent any additional upward motion. The lever 46 is able to pivot about lever shaft 48. As the rear end 88 of the warning post enlarged base 64 contacts roll pin 50, it forces the lever 46 to pivot down and away from the warning post base 64 until the smaller diameter of the warning post 12 passes the roll pin 50. Then lever 46 with roll pin 50 is drawn upward by pin spring 54. Because of the smaller diameter in this location the roll pin 50 and lever 46 return to the horizontal position shown in FIGS. 1 and 2. The warning post 12 wants to be drawn upward by post spring 74, but will only go up until the top shoulder 62 contacts the bottom surface of roll pin 50 when lever 46 is horizontal. This is the set and locked position. The warning post 12 will stay in this position until trigger 20 is activated.

When the vehicle is driving through uneven terrain and contact is made between the terrain and trigger 20 the following events will occur. As contact occurs trigger 20 will rotate about variable tension adjuster shaft 24. Rotation of trigger 20 will be from the set vertical of FIGS. 1 and 2 toward the horizontal as indicated in FIG. 4. As the trigger 20 starts its rotation, a caming action takes place between cam member 26 and plunger assembly 42. Plunger assembly 42 will cam upward into lever 46 as trigger 20 rotates toward the horizontal. As the plunger assembly 42 pushes the forward lever end 66 up, the bifurcated rear lever end 52 pivots downward. Roll pin 50 which is seated on post shoulder 62 will draw the warning post 12 downward until roll pin 50 is clear of the larger post base diameter, then post spring 74 will thrust the warning post indicator 12 to expose a fluorescent color painted on post 12 to alert the tank crew that the obstruction detector has been activated.

To increase tension on the trigger, depress detent pin 38 and rotate hex-headed variable tension adjuster 34 counter clockwise until detent plunger pin 38 pushes back out into slot 38 to lock adjuster 34 to desired tension level.

While a specific embodiment of the invention has been shown and described in detail to illustrate the application of the principles of the invention, it will be understood that the invention may be embodied otherwise without departing from such principles.

What is claimed is:

1. A gun bore obstruction detector indicator for an armored vehicle which comprises:

a housing operatively attached to the muzzle end of said gun bore;

triggering means rotatably supported in said housing for moving in response to said gun bore hitting an obstruction;

variable tensioning means operatively attached to said housing and said triggering means for changing the torque force necessary to move said triggering means;

caming means operatively connected to said triggering means for translating rotary motion of said triggering means to a vertical movement;

plunger means slidably contacting said caming means for vertically moving in response to said caming means;

indicator shaft means operatively disposed in said housing for indicating when said bore is clear and when said muzzle end has hit an obstruction; and lever means rotatably supported by said housing for locking said shaft means in an untriggered position when said bore is clear of obstruction and for releasing said shaft means to protrude visably from said housing when said muzzle end of said gun bore has hit an obstruction.

2. A gun bore obstruction indicator as recited in claim 1 wherein said triggering means includes:

a trigger shaft;

a trigger member fixedly supported on said trigger shaft; and a trigger spring collar fixedly mounted on said trigger shaft in juxtaposition with said caming means and positioned intermediate said variable tensioning means and said trigger spring collar.

3. A gun bore obstruction indicator as recited in claim 2 wherein said variable tension means includes:

a hex-shaped member rotatably mounted on said trigger shaft said hex member having detent grooves therein;

a detent pin slidably positioned in said housing in alignment with said detent grooves; and a trigger tensioning spring fixedly attached on one end of said hex member and on another end to said trigger collar.

4. A gun bore obstruction as recited in claim 3 wherein said caming means includes a cam member fixedly positioned on said trigger shaft intermediate said trigger spring collar and said trigger member.

5. A gun bore obstruction indicator as recited in claim 4 wherein said plunger means includes:

a cylindrical plunger member having a closed top end and an open bottom end;

a plunger compression spring operatively disposed in said open bottom end of said plunger member; and a bottom contact member slidably disposed in said plunger spring bore and held against said cam member by said plunger compression spring.

6. A gun bore obstruction detector indicator as recited in claim 5 wherein said shaft means includes:

a post indicator slidably disposed in said housing having a fluorescent coated post end and an enlarged rear base end;

a post spring anchor disposed in said enlarged rear base end; and a post tension spring having a top end connected to said housing and a bottom end connected to said enlarged rear base post spring anchor.

7. A gun bore obstruction detector indicator as recited in claim 6 wherein said lever means includes:

a roll pin lever having a closed end and a bifurcated end;

a roll pin fixedly disposed in same bifurcated end;

a helical pin spring tensionally connected on one end to said roll pin and on a second end to said housing; and a lever pivot for allowing said lever to rotate in response to movement of said trigger member.

* * * * *